US010370871B2

(12) United States Patent
Garrow et al.

(10) Patent No.: US 10,370,871 B2
(45) Date of Patent: Aug. 6, 2019

(54) OVERHEAD DOOR LOCK

(71) Applicant: DL Manufacturing, North Syracuse, NY (US)

(72) Inventors: Kristian P. Garrow, Cortland, NY (US); Donald L. Metz, Kirkville, NY (US)

( * ) Notice: Subject to any disclaimer, the term of this patent is extended or adjusted under 35 U.S.C. 154(b) by 212 days.

(21) Appl. No.: 15/260,313

(22) Filed: Sep. 8, 2016

(65) Prior Publication Data

US 2017/0089099 A1 Mar. 30, 2017

Related U.S. Application Data

(60) Provisional application No. 62/215,627, filed on Sep. 8, 2015.

(51) Int. Cl.
*E05B 65/00* (2006.01)
*E05B 67/38* (2006.01)

(52) U.S. Cl.
CPC ..... *E05B 65/0021* (2013.01); *E05B 67/383* (2013.01); *E05B 2067/386* (2013.01)

(58) Field of Classification Search
CPC ..... E05B 65/0021; E05B 67/383; E05B 2067/386
USPC ..... 70/95–100; 292/67, 148, 143, 244, 205, 292/238, 245, 340, 341.11, 341.12, 292/341.13, 341.17, 146, 152, DIG. 36
See application file for complete search history.

(56) References Cited

U.S. PATENT DOCUMENTS 2,198,079 A * 4/1940 Ferris ..... E05B 67/383 292/143
2,329,348 A * 9/1943 Honig ..... E05B 65/0021 292/125
2,665,932 A * 1/1954 Moler ..... E06B 9/80 292/177
2,794,663 A * 6/1957 Grodt ..... E05C 3/167 292/148
2,988,909 A * 6/1961 Moler ..... E05B 65/0021 160/191
3,095,225 A * 6/1963 Domsic ..... E05C 1/16 292/169.15
3,285,646 A * 11/1966 Foss ..... E05B 65/0021 292/133
3,514,142 A * 5/1970 Smith ..... E05B 13/002 292/108
3,838,877 A * 10/1974 Hanson ..... E05B 65/0021 292/134

(Continued)

*Primary Examiner* — Suzanne L Barrett
(74) *Attorney, Agent, or Firm* — Barry F. Manna

(57) ABSTRACT

A lock assembly for an overhead door includes a lock bar and a spring clip receiver. The lock bar is configured to mount on and travel with the overhead door, and includes a track cover portion configured to encircle an overhead door guide track. The lock bar further includes a latch portion extending from the track cover portion. The spring clip receiver includes a spring clip configured to receive the latch portion of the lock bar, and a lock receiver having a pass-through hole for a lock shackle so that, when the overhead door is in a closed position, the lock shackle captures both the lock bar and the spring clip receiver to immobilize the overhead door. The lock assembly may further include an alignment bracket coupled to the lock bar defining an aperture configured to align with the pass-through hole in the lock receiver when the overhead door is in a closed position.

11 Claims, 6 Drawing Sheets

(56) References Cited

U.S. PATENT DOCUMENTS 3,907,344 A * 9/1975 Newlon ..... E05C 3/167 292/244
4,618,174 A * 10/1986 Duke ..... E05F 15/668 292/135
4,659,121 A * 4/1987 McGee ..... E05B 47/0002 292/144
4,697,442 A * 10/1987 Stendal ..... E05B 47/0002 292/201
4,741,564 A * 5/1988 Alford ..... E05C 19/08 292/205
5,544,924 A * 8/1996 Paster ..... E05B 15/0006 160/201
5,732,758 A * 3/1998 Marko ..... E06B 3/485 160/201
5,806,351 A * 9/1998 Learnahan ..... E05B 67/383 292/148
6,463,989 B1 * 10/2002 Johnson ..... E05B 65/0894 160/201
7,011,347 B2 * 3/2006 Finardi ..... E05B 65/0021 160/201
7,021,678 B1 * 4/2006 Raoult ..... A01K 1/0017 256/1
7,114,753 B2 * 10/2006 Nodorft ..... E05B 47/0002 292/137
7,600,344 B2 * 10/2009 Michaud ..... E05D 13/006 49/322
7,784,520 B2 * 8/2010 Paulson ..... E05D 15/24 16/91
8,789,859 B2 * 7/2014 Curtis ..... E05B 15/0295 292/201
9,187,931 B2 * 11/2015 Hudson ..... E05B 65/0021
9,777,512 B2 * 10/2017 Curtis ..... E05B 65/0021
9,874,045 B2 * 1/2018 Buchanan ..... E05C 1/04
2017/0183897 A1 * 6/2017 Bruckelmyer ..... E05B 17/0025

* cited by examiner

OVERHEAD DOOR LOCK

CROSS REFERENCE TO RELATED APPLICATIONS

Reference is made to and this application claims priority from and the benefit of U.S. Provisional Application Ser. No. 62/215,627, filed Sep. 8, 2015, entitled "OVERHEAD DOOR LOCK", and U.S. Provisional Application Ser. No. 62/343,147, filed May 31, 2016, entitled "OVERHEAD DOOR LOCK", which applications are incorporated herein in its entirety by reference.

FIELD OF THE INVENTION

This disclosure relates generally to an overhead door assembly and, more specifically, to a lock assembly to prevent the overhead door from being raised.

BACKGROUND OF THE INVENTION

Overhead door assemblies, such as those generally utilized in loading docks, garages, warehouses, or other enclosed structures, typically include a sectional door assembly that is guided by a vertical track installed on either side of the doorway. Follower elements, such as rollers, are typically affixed to the door assembly and ride within the track as the door is raised and lowered. The door may be raised and stored in a generally vertical orientation, such as found in vertical lift and high lift installations, or the door may travel to a horizontal overhead position, such as found in a standard lift installation. Regardless of configuration, the doors can be manually operated up and down, or motor-driven. To ease the operation of the door, a torsion spring is often used to offset the weight of the door assembly.

Security is an important concern for many homes and businesses, and various locking mechanisms have been devised for overhead doors for this purpose. One such slide lock, disclosed in U.S. Pat. No. 5,489,130, has a base adapted to be mounted on the door, and has a mounting plate and a pair of spaced apart legs. Each leg carries a slide aperture, and one leg includes a lockout hole. A striker plate is attached to the door channel in a position collinear with the base. A spring biased striker is carried by the base and when the door is manually operated, the striker is placed in an operative position where it slides freely through generally aligned slide apertures. When the door is motor operated, the striker may be placed in an inoperative lockout position by placing one end of the striker in the lockout hole. When the striker is in the inoperative lockout position, it cannot contact the striker plate when the door is in the closed position. However, the striker may be easily moved to the operative locking position by overcoming the spring bias, and moving the striker into the slide aperture and thus engageable with the striker plate to lock the door in the closed position.

Another type of lock comprises a spring-loaded locking latch mounted to the door track. As the door is lowered, a plate mounted to the door engages the spring-loaded locking latch and pushes it out of the way. When the door reaches its fully closed position, the plate passes by the locking latch and the latch springs back into place. The latch is designed such that the door-mounted plate cannot move the latch when the door is raised. Thus, the latch provides an obstruction to the plate, and the door is prevented from being raised. A handle on the locking latch moves the obstruction out of the way so the door can be raised.

One of the simplest overhead door locks includes a spring-loaded slider element fastened to the door panel. When the door is closed, the slider element passes through a corresponding slot in the guide track. The slider element includes a hole near the tip portion, so a padlock shackle or the like may pass through the hole once the slider element passes through the slot. When the lock engages the slider element passed through the guide track, the overhead door cannot open.

SUMMARY OF THE INVENTION

Although these existing locks can be useful and may be advantageous for certain applications, they suffer from drawbacks. Specifically, the spring-loaded locking latch relies on the door track for strength. The locking latch is bolted or otherwise fastened to the door track, which is typically formed of thin aluminum. Over time and with repeated hits from the door-mounted plate, the locking latch may damage the aluminum track, which increases costs.

One drawback to common spring-loaded slider element type of lock is that, upon unlocking, the operator may not fully retract the slider element. The slider element clears the slot in the track guide, but may still occupy an internal portion of the guide track. When the door is raised on a standard lift installation, for example, the slider element jams into the curved portion of the track, causing damage to the track.

In accordance with one aspect of the disclosure, a lock assembly for an overhead door includes a lock bar and a spring clip receiver. The lock bar is configured to mount on and travel with the overhead door, and includes a track cover portion configured to encircle an overhead door guide track. The lock bar further includes a latch portion extending from the track cover portion. The spring clip receiver is configured to remain immovable relative to the overhead door, includes a spring clip configured to receive the latch portion of the lock bar when the overhead door is in a closed position. The spring clip receiver further includes a lock receiver having a pass-through hole for a lock shackle so that, when the overhead door is in a closed position, the lock shackle captures both the lock bar and the spring clip receiver to immobilize the overhead door.

In one embodiment, the lock assembly further includes an alignment bracket coupled to the lock bar. The alignment bracket defines an aperture configured to align with the pass-through hole in the lock receiver when the overhead door is in a closed position.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
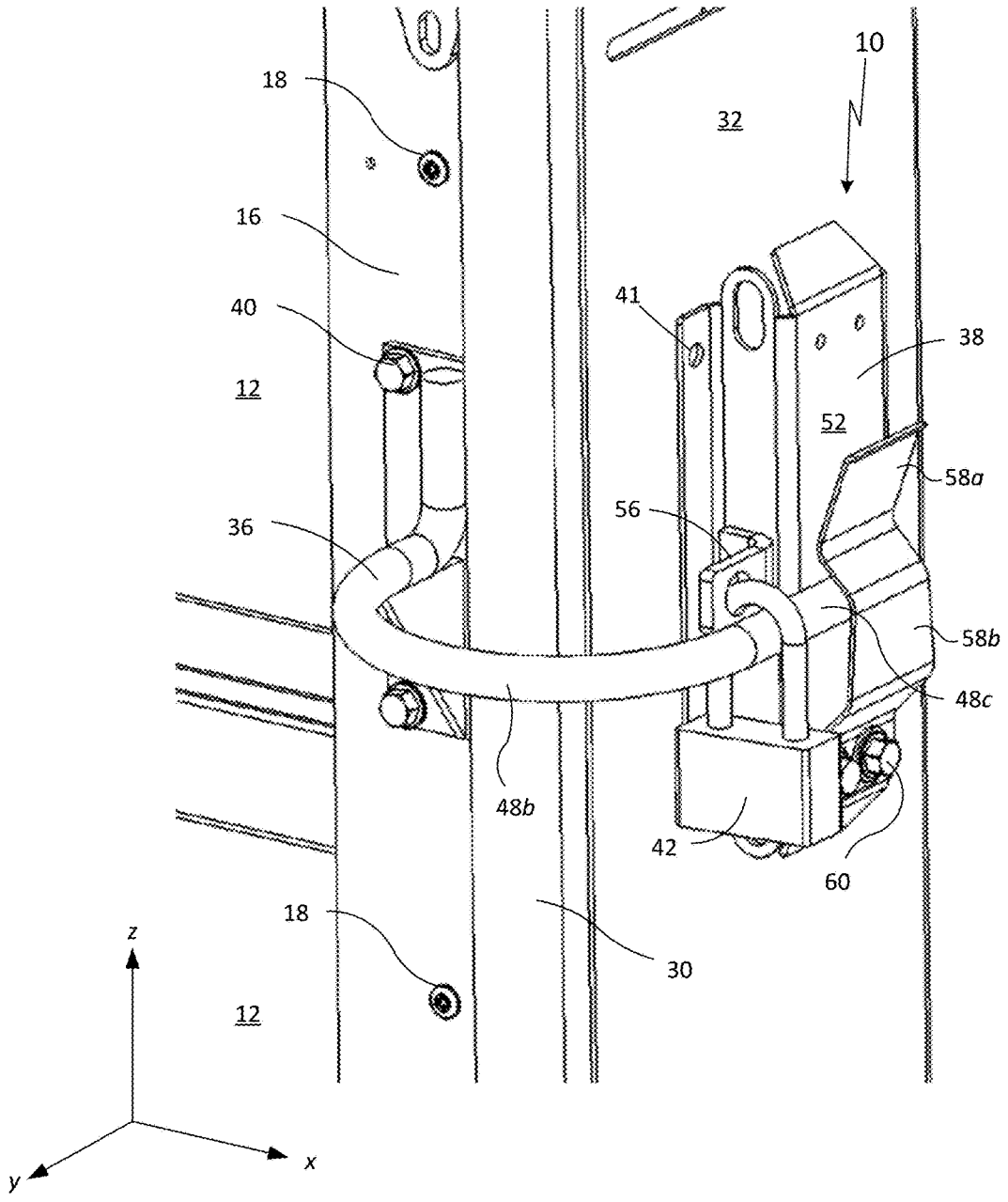
FIG. 1 depicts a side perspective view of a lock assembly according to one embodiment of the invention.
Figure 2:
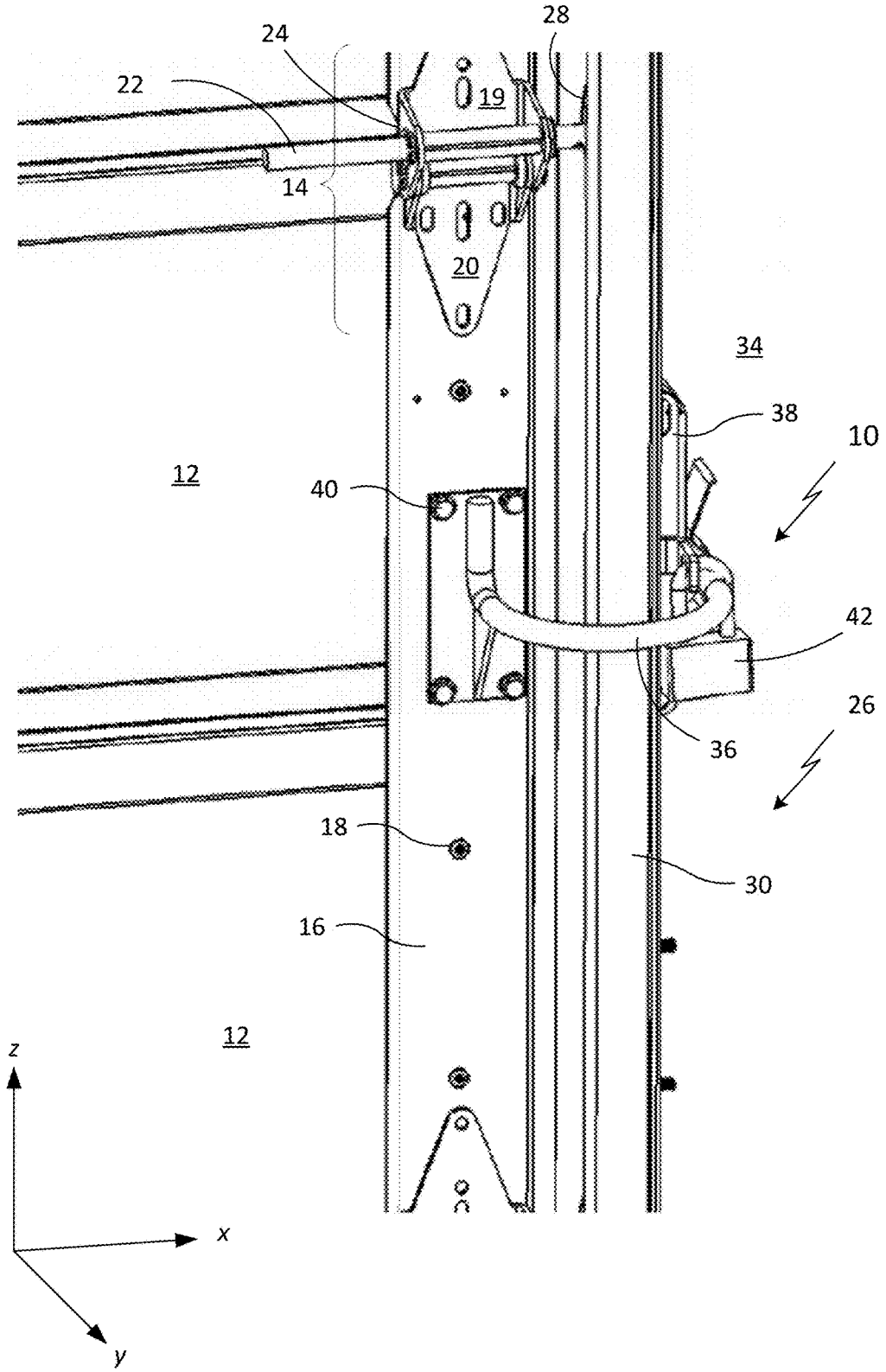
FIG. 2 depicts a front perspective view of the lock assembly shown in FIG. 1.

Referring to FIGS. 1 and 2, shown is an overhead door secured by a lock assembly 10 according to one embodiment of the invention. The view is illustrated from within a loading dock bay looking towards the outside environment. For purposes of illustration and to further explain orientation of certain features of the invention, a lateral axis is defined as substantially parallel to the loading dock wall and is denoted as the x-axis; a longitudinal axis is defined as substantially in the direction of vehicle motion when backing into the loading dock and is denoted as the y-axis; and the vertical axis is denoted as the z-axis.

The construction of the overhead door may include elongated sectional door panels 12 extending transversely across the width of the door opening. In one example, each door panels 12 may be formed of ultraviolet-inhibited, weather resistant polyvinylchloride (PVC), and the panels may be arranged vertically atop one another with an interlocking feature. In another example, the door panels 12 may be formed of a metal such as steel. The door panels 12 may be pivotally connected by hinges 14 to permit relative rotation between them. An end cap 16 may be provided to support the elongated door panels 12 on each side. In the illustrated embodiment, the end cap 16 is a U-shaped vertical channel that captures and surrounds the end of one or more panels 12. In one example, the end cap 16 may be formed of galvanized steel. The end cap 16 may be secured to the panels 12 with fasteners 18, such as screws or the like, and the fasteners 18 may also secure the hinges 14 to the end cap. The hinges 14 include an upper half 19 and a lower half 20 rotatably coupled to a shaft 22 via bushings 24.

The overhead door is guided by a vertical guide track assembly 26. The guide track assembly 26 may be a high lift, a vertical lift, or a standard lift, for example. A track follower element 28 at the end of the shaft 22 rides in the U-shaped vertical channel of a sheet metal guide track 30. The guide track assembly 26 may further include a vertical mounting bracket 32, which may be formed of heavy gage steel. The mounting bracket 32 is in turn secured to a wall 34 of the loading dock. Thus, the guide track assembly 26 provides a support structure for the overhead door.

The lock assembly 10 includes a two-piece structure; a moveable lock bar 36 and a stationary spring clip receiver 38. The lock bar 36 mounts to a portion of the overhead door assembly, and travels up and down with the door (it is stationary with respect to the door). In the illustrated embodiment, the lock bar 36 mounts to the metal end cap 16 using drill screws 40 or the like, such as ¼-14×1.0 hex washer head drill screws. The spring clip receiver 38 mounts to the support structure for the overhead door and is immovable. In the illustrated embodiment, the spring clip receiver 38 mounts to the vertical mounting bracket 32 at locations indicated by 41, using ¼-20×⅝ slotted track bolts and ¼-20 flange nuts, for example. When the overhead door is in the closed position, the lock bar 36 and the spring clip receiver 38 align so a padlock 42 can fasten the two bracket portions together.

Figure 3:
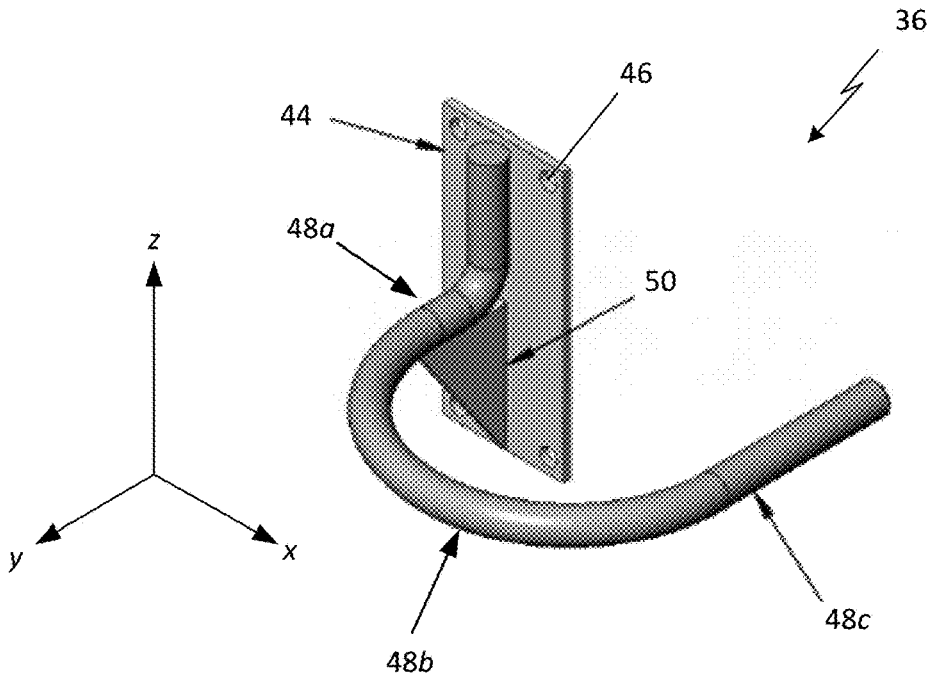
FIG. 3 depicts a front perspective view of a lock bar as shown in FIG. 1.

FIG. 3 illustrates the lock bar 36 in greater detail. The lock bar 36 includes a door mount portion 44 to secure the lock bar to a surface of the overhead door. In one example, the door mount portion 44 may be a simple flat plate structure with mounting holes 46 for the drill screws 40. The lock bar 36 further includes a track cover portion 48 that includes a straight section **48*a* extending transversely (e.g., in the y-axis) away from the door mount portion 44, a semi-circular portion 48*b* that encircles the guide track 30, and a latch portion 48*c* that engages the spring clip receiver 38. The track cover portion 48 may be sized to extend beyond and around the guide track 30 of the guide track assembly 26 in all orientations. For example, in a standard lift door, the track cover portion 48 is configured to always have clearance with the guide track 30, even when the guide track is curved or horizontal. In this manner, the lock bar 36 will not interfere with the guide track 30 when the door is in motion, thereby alleviating any potential for damage to the track. In one example, the semi-circular portion 48*b* may have a radius of approximately 2.25 inches. The lock bar 36 may further include one or more gussets 50 to provide a more robust structure. In one example, the lock bar 36 may be formed from 3/16 inch galvanized annealed steel, with the track cover portion 48 and the gusset 50 being welded to the door mount portion 44**.

Figure 4:
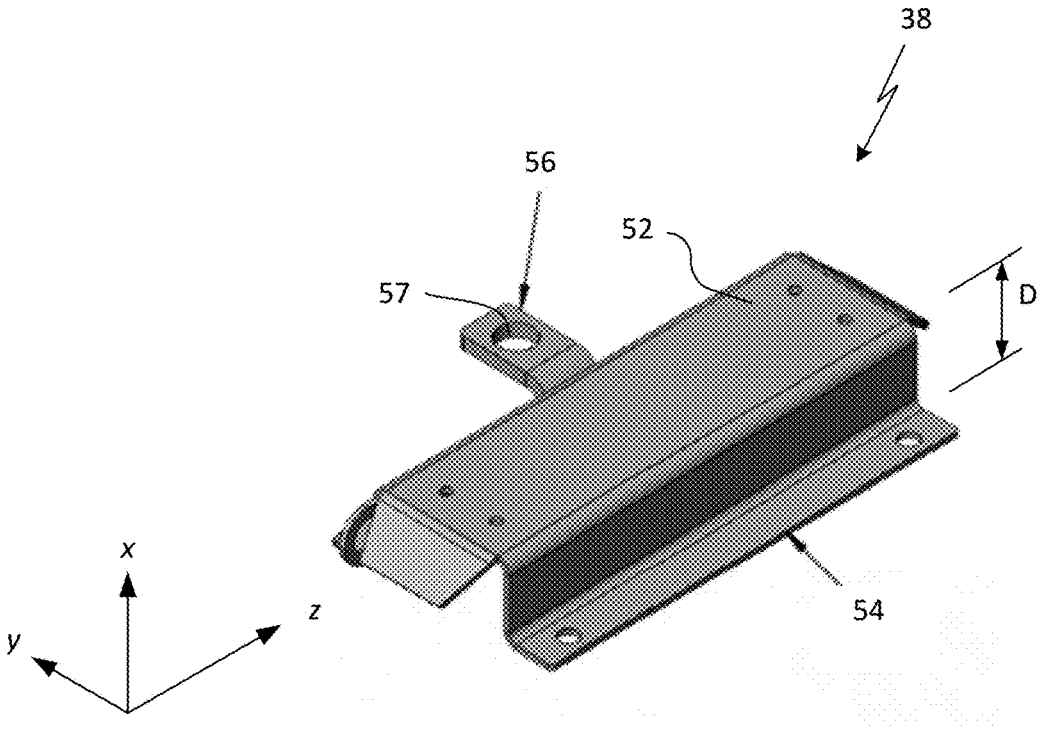
FIG. 4 depicts a top perspective view of a spring clip receiver as shown in FIG. 1.

FIG. 4 illustrates the spring clip receiver 38 in greater detail. A box-like body portion 52 may be rectangular in shape, with the long face extending in the vertical z-axis, and the shorter face extending in the y-axis (towards the interior of the loading dock). The spring clip receiver 38 stands proud to the mounting bracket 32 a distance D in the lateral x-direction so as to provide clearance for the semi-circular portion **48*b* of the lock bar 36. In one example, the distance D is approximately 1.0 inch. The body portion 52 may further include mounting tabs 54 defining screw holes to secure the spring clip receiver 38 to the mounting bracket 32**.

The spring clip receiver 38 may further include a lock receiver 56, which may comprise a tab defining a hole 57 or opening of sufficient size so as to pass through the shackle of the padlock 42. The pass-through hole 57 of the lock receiver 56 should be configured in close proximity to the latch portion **48*c* of the lock bar 36 when the overhead door is in a closed position. In this manner, the shackle of the lock will capture both the lock bar 36 and the spring clip receiver 38, effectively immobilizing the overhead door, as shown in FIG. 1**.

Omitted from FIG. 4 but still a component of the spring clip receiver 38 is a spring clip 58, shown in FIG. 1. The spring clip 58 includes a capture portion **58*a* configured in a wedge or funnel shape to guide the latch portion 48*c* of the lock bar 36 downwards into a latch receiver portion 58*b* of the spring clip. The capture portion 58*a* necks down to a restriction gap that is sized less than the thickness or diameter of the latch portion 48*c* of the lock bar 36. By virtue of its construction, the momentum of the closing overhead door forces the latch portion 48*c* to engage and spread open the capture portion 58*a*, thereby widening the restriction gap, so the latch portion 48*c* passes through the gap to the latch receiver portion 58*b*. At that point, the overhead door is closed, and the latch portion 48*c* will not travel further downwards and is thus received in the latch receiver portion 58*b* of the spring clip receiver 38. Once the latch portion 48*c* passes through the restriction gap, the spring clip 58 returns to its original position. The latch portion 48*c* of the lock bar 36 is then held firmly in place within the latch receiver portion 58*b* because a good deal of force is required (i.e., a firm, upwards jerking motion) to overcome the restriction gap and release the track cover portion 48 of the lock bar 36**.

The spring clip 58 may include provision for screw holes in the base or bottom portion, such that screws 60 or the like may fasten the spring clip 58 to the body portion 52. In one example, the spring clip receiver 38 and the spring clip 58 may be formed from 3/16 inch galvanized annealed steel, and the spring clip 58 may be secured to the body portion 52 using #10×3/4 TEK screws.

Figure 5:
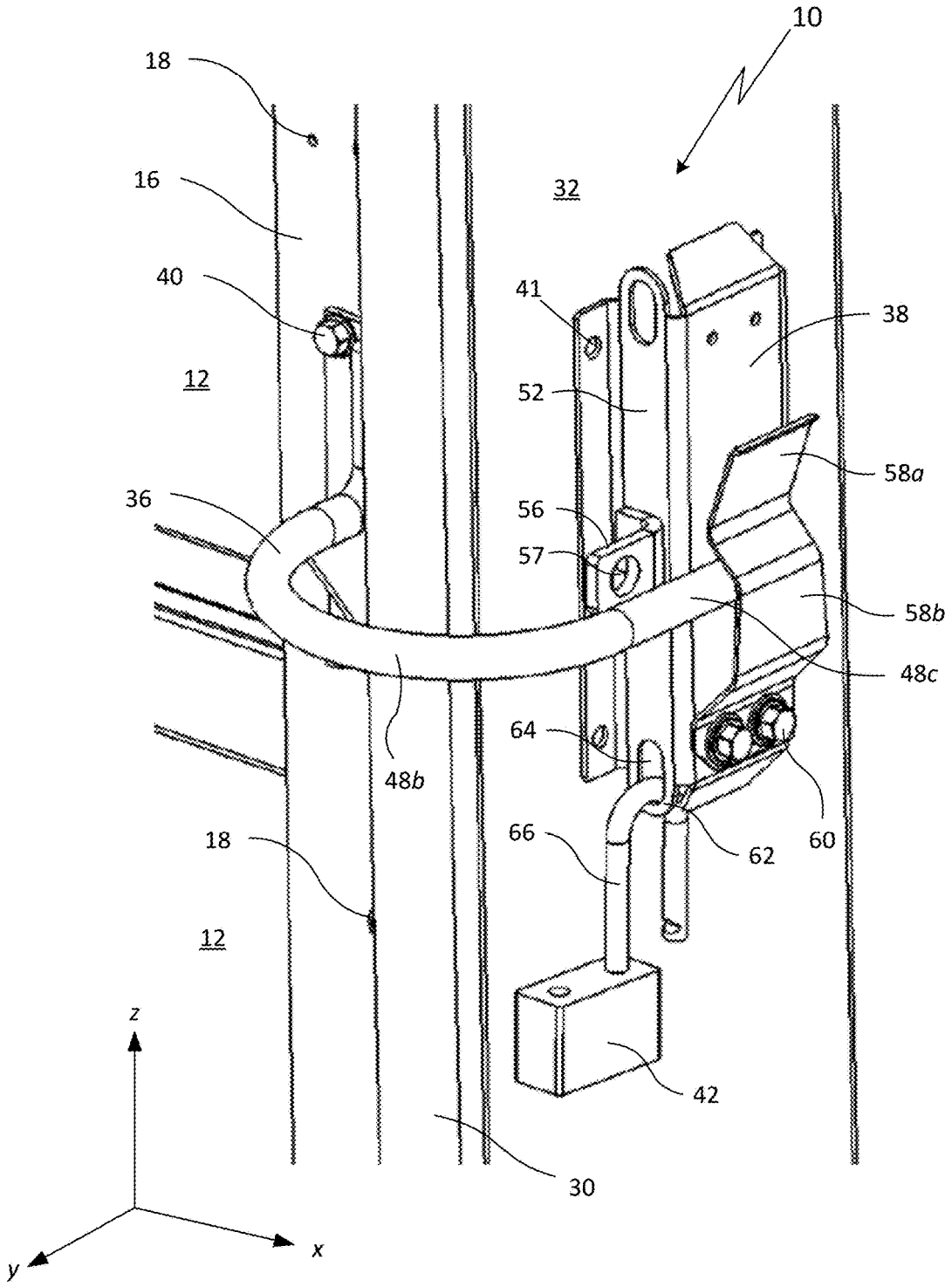
FIG. 5 depicts the lock assembly shown in FIG. 1 with the lock removed.

FIG. 5 illustrates the lock assembly 10 shown in FIG. 1, but the padlock 42 has been removed from the lock bar 36 and stowed on a retainer element 62 to prevent accidental misplacement or loss of the lock. In the illustrated embodiment, the retainer element 62 is integral with the spring clip receiver 38. For example, the raised side of the body portion 52 may define an aperture 64 or slot sized to accept the lock shackle 66.

One potential problem with the lock assembly 10 depicted in FIG. 5 is that a door operator may close the overhead door, engage the latch portion 48*c* of the lock bar 36 in the spring clip 58, but fail to properly engage the shackle 66 with the lock receiver 56. For example, the operator may inadvertently clasp the shackle 66 over the latch portion 48*c* without actually passing the shackle through the hole 57 in the lock receiver 56. This scenario may give the appearance that the door is locked when in fact it is not.

Similarly, a door operator may fail to fully engage the latch portion 48*c* of the lock bar 36 in the spring clip 58, but attempt to lock the overhead door anyway. The latch portion 48*c* may obstruct the receiver hole 57 from view and, in a similar manner, the operator may inadvertently clasp the shackle 66 over the latch portion 48*c* without actually passing the shackle through the hole 57 in the lock receiver 56. In this scenario, the overhead is not only unlocked, but also slightly open.

Figure 6:
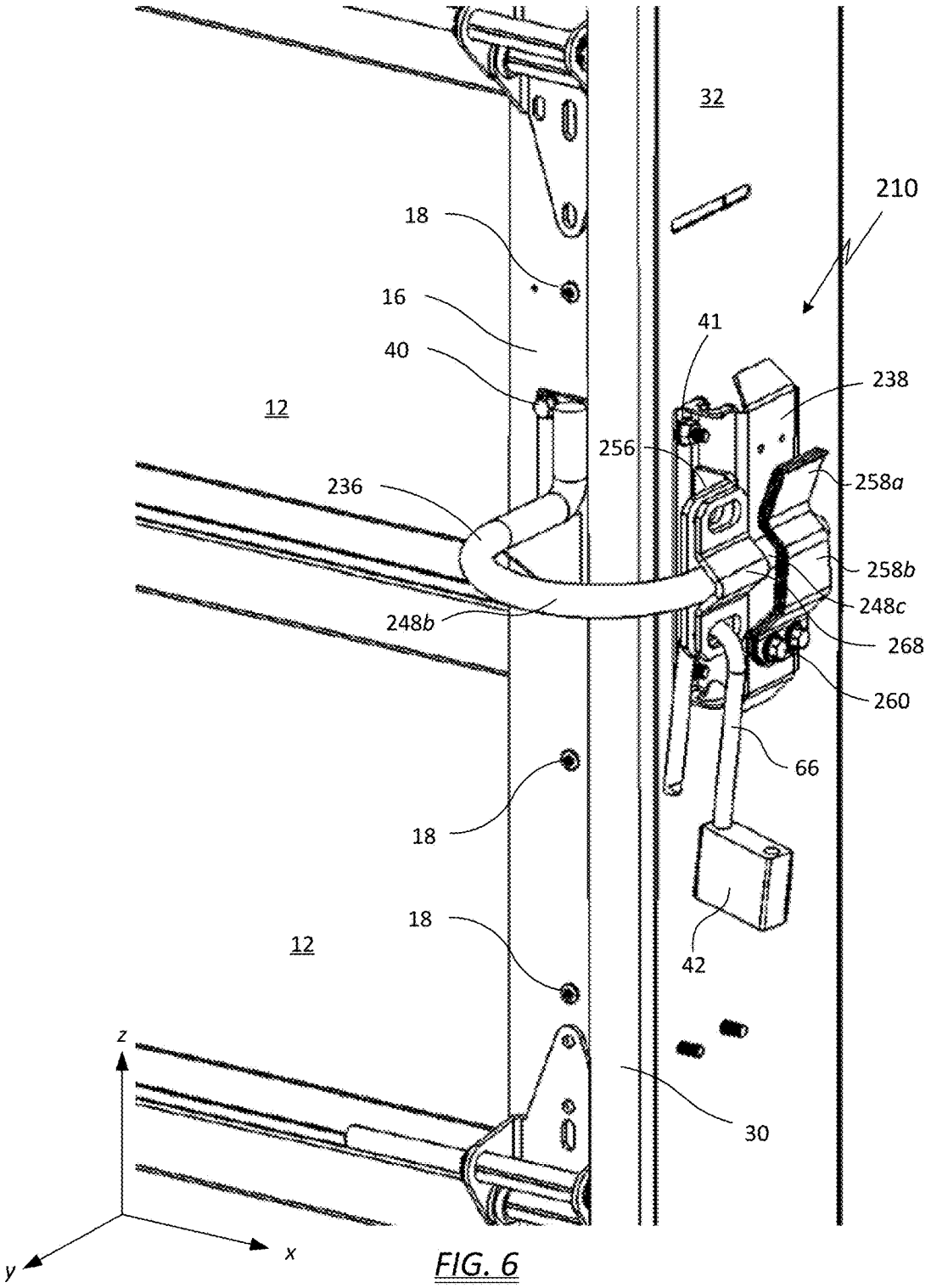
FIG. 6 depicts a side perspective view of a lock assembly according to another embodiment of the invention.
Figure 7:
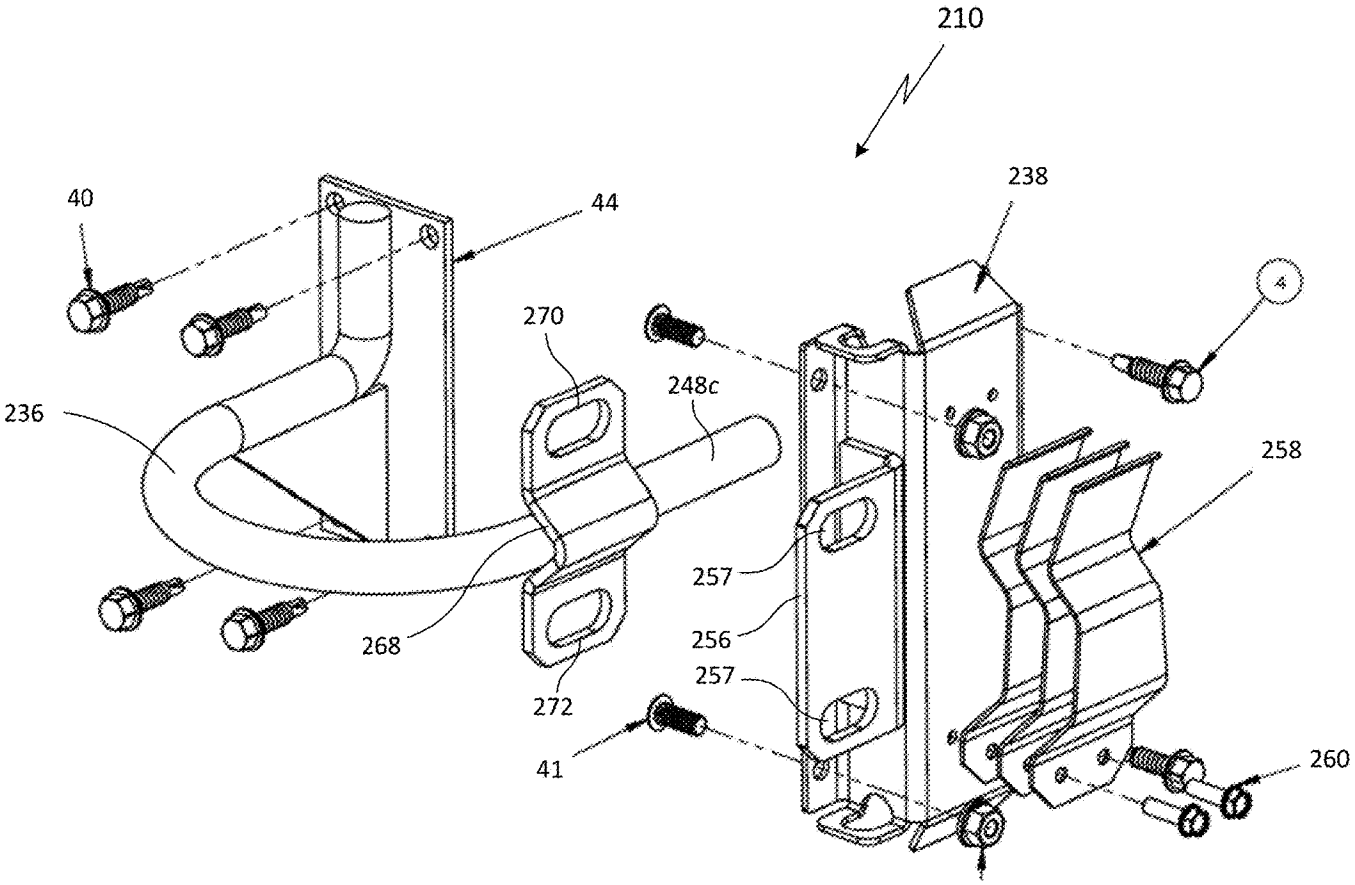
FIG. 7 depicts an exploded view of the lock assembly shown in FIG. 6.

Turning now to FIGS. 6 and 7, wherein like numerals indicate like elements in FIGS. 1-5, shown is a lock assembly 210 that lessens the chance of failing to pass the shackle through the hole in the lock receiver. The lock assembly 210 includes one or more design features to provide more robust operation of the lock assembly with the overhead door. In one embodiment, the latch portion 248*c* of the lock bar 236 includes an alignment bracket 268 to better assure the lock bar 236 is properly aligned with the lock receiver 256. The alignment bracket 268 may include an upper alignment slot 270 and a lower alignment slot 272 that are configured to align with mating holes 257 in the lock receiver 256 when the overhead door is properly closed. The lock shackle 66 may be passed through either upper alignment slot 270 or lower alignment slot 272. Furthermore, the alignment bracket 268 may be laterally offset a small distance (i.e., approximately 0.125-0.250 inches) from the face of lock receiver 256 to allow for the positional variability of the overhead door relative to the vertical mounting bracket 32.

The alignment bracket 268 may be formed integral with the latch portion 248*c* of the lock bar 236 to assure its positional accuracy. For example, the alignment bracket 268 may be formed of steel and welded to the latch portion 248*c* of the lock bar 236.

In another embodiment, components may be color-coded to help an operator assure the lock bar 236 is properly aligned with the spring clip receiver 238. For example, the alignment bracket 268 and the latch portion 248*c* of the lock bar 236 may be painted red, while the spring clip receiver 238 (or at least the lock receiver portion 256) may be painted a contrasting color such as yellow. In this manner, when the door is lowered to its properly closed position, the operator receives a visual verification that the alignment slots 270, 272 are aligned with the receiver holes 257.

In another embodiment of the invention, a latch receiver 258 may require increased stiffness to prevent accidental door opening, for example. The latch receiver 258 may be fabricated from thicker sheet stock or, as illustrated, may comprise a plurality of thinner latch receivers, such as those described with reference to FIGS. 1-5. The illustrated embodiment has the benefit of offering customers a range of increasing spring rates, such as that achieved with one, two, three, or more thinner latch receivers.

One of the improvements of the disclosed lock assembly 10 is that, when fastened in place and an attempt is made to open the locked overhead door, the forces exerted on the stationary structure (i.e., guide track assembly 26) do not act on the flimsy guide track 30, which is easily damaged and time-consuming to fix. Rather, the reaction forces act through spring clip receiver 38 to the overhead door mounting bracket 32, which is more rugged and durable.

Another improvement is that, once the lock bar 36 is engaged by the spring clip receiver 38, the spring action secures it so it will not move. In contrast, other overhead door locks retain a significant amount of 'play' so the overhead door can be rattled when locked, which degrades the components such as the guide track.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

The invention claimed is:

1. A lock assembly for an overhead door, comprising:

a lock bar configured to mount on and travel with the overhead door, the lock bar comprising a track cover portion forming a semi-circle around an overhead door guide track, and further comprising a latch portion extending from the track cover portion; and a spring clip receiver configured to remain immovable relative to the overhead door, the spring clip receiver comprising a spring clip configured to receive the latch portion of the lock bar when the overhead door is in a closed position, the spring clip receiver further comprising a lock receiver having a pass-through hole for a lock shackle;

wherein, when the overhead door is in a closed position, the lock shackle captures both the lock bar and the spring clip receiver to immobilize the overhead door.

2. The lock assembly according to claim 1, wherein the semi-circle has a radius of about 2.25 inches.

3. The lock assembly according to claim 1, wherein the overhead door is a standard lift door having a curved guide track, and the track cover portion of the lock bar is configured to maintain a clearance with the curved track guide.

4. The lock assembly according to claim 1, wherein the spring clip receiver mounts to a vertical mounting bracket supporting the overhead door guide track.

5. The lock assembly according to claim 1, wherein the spring clip receiver mounts to a wall.

6. The lock assembly according to claim 1, further comprising a retainer element configured to store a door lock when not in use.

7. The lock assembly according to claim 6, wherein the retainer element defines an aperture sized to accept a shackle of the door lock.

8. The lock assembly according to claim 6, wherein the retainer element is integral with the spring clip receiver.

9. The lock assembly according to claim 1, further comprising an alignment bracket coupled to the lock bar, the alignment bracket defining an aperture configured to align with the pass-through hole in the lock receiver when the overhead door is in a closed position.

10. The lock assembly according to claim 9, wherein the alignment bracket is integral with the latch portion of the lock bar.

11. The lock assembly according to claim 9, wherein the alignment bracket and the spring clip receiver are color-coded in contrasting colors.

* * * * *